United States Patent [19]

Carlsson

[11] 4,112,256

[45] Sep. 5, 1978

[54] LOUDSPEAKER AND STEREOPHONIC LOUDSPEAKER SYSTEM

[76] Inventor: Stig Carlsson, Torkel Knutssonsgatan 15, Stockholm, Sweden

[21] Appl. No.: 738,006

[22] Filed: Nov. 2, 1976

Related U.S. Application Data

[63] Continuation of Ser. No. 498,574, Aug. 19, 1974, abandoned.

[30] Foreign Application Priority Data

Aug. 24, 1973 [SE] Sweden ..... 7311561

[51] Int. Cl.[2] ..... H04R 5/02

[52] U.S. Cl. ..... 179/1 GA; 181/154

[58] Field of Search ..... 179/1 E, 1 GA; 181/144–156, 199

[56] References Cited

U.S. PATENT DOCUMENTS

| | | | |
|---|---|---|---|
| 3,540,544 | 11/1970 | Karlson | 181/154 |
| 3,754,618 | 8/1973 | Sasaki | 179/1 GA |
| 3,759,345 | 9/1973 | Borisenko | 179/1 GA |
| 3,903,989 | 9/1975 | Bauer | 181/144 |

FOREIGN PATENT DOCUMENTS

| | | | |
|---|---|---|---|
| 150,559 | 9/1937 | Austria | 181/144 |
| 1,199,441 | 6/1959 | France | 179/1 E |
| 1,242,046 | 8/1960 | France | 181/154 |
| 1,000,449 | 1/1957 | Fed. Rep. of Germany | 181/154 |
| 891,014 | 3/1962 | United Kingdom | 179/1 E |

*Primary Examiner*—George G. Stellar

*Attorney, Agent, or Firm*—Burmeister, York, Palmatier, Hamby & Jones

[57] ABSTRACT

A loudspeaker has a rectangular casing providing a frontal wall in which are mounted a plurality of speaker mechanisms responding to differing frequency ranges. The high frequency speaker is oriented so that the axis of radiation is inclined upwardly and to one side of the normal to the front wall. In the preferred embodiments a lower frequency speaker, such as a low and midfrequency speaker, is similarly oriented but to a slightly lesser angle of inclination. The front wall has a conically concave portion the axis of which is similarly inclined, to accommodate the lower frequency speaker, and the high frequency speaker is mounted on the conical wall portion. Some embodiments also have a separate low frequency speaker. Two such speakers are located, widely spaced laterally from each other, adjacent the wall of a room with the left hand speaker radiating to the right and the right one radiating to the left.

13 Claims, 11 Drawing Figures

LOUDSPEAKER AND STEREOPHONIC LOUDSPEAKER SYSTEM

This is a continuation of application Ser. No. 498,574, filed Aug. 19, 1974 now abandoned.

This invention is related to loudspeakers for use in two or four-channel stereophonic sound reproduction, intended to be placed in the required numbers on vertical or horizontal walls.

In most cases loudspeakers for stereophonic sound reproduction have the shape of a right-angled parallelepiped and are intended to be placed on a horizontal wall, for example a shelf in a bookcase, or on a vertical wall, in the latter case with the aid of suspension devices. These loudspeakers normally have their loudspeaker mechanism or means arranged in the front wall and usually with the axis of radiation pointing straight forwards from the loudspeaker.

This well known loudspeaker shape offers in many cases great advantages from the point of view of positioning and space, but these advantages have hitherto been combined with considerable acoustical shortcomings. In order to achieve good stereo reproduction it is therefore sometimes recommended that the two loudspeakers be turned inwards towards the listening area or an area immediately in front of it, but the advantages of the shape are thereby considerably reduced from the positioning point of view. Irrespective of how the loudspeakers are turned in relation to the listeners, this loudspeaker shape gives rise, however, to characteristic listening impressions and directional impressions which result in a greater directional sharpness than would be found when listening to natural sound sources in a normal interior listening environment. As a result the reproduction is not experienced as acoustically life-like. These effects are connected with the time and directional course of events of the direct sound and that part of the reflected sound which reaches the listener within the first 20 or 30 milliseconds after the direct sound. However, the relation between the directional properties of a sound source and the listening impression is to a great extent covered behind a lack of knowledge and descriptive systems.

Some loudspeakers of this type have one or more of their loudspeaker means arranged in an inclined position, so that they have one or more axes of radiation pointing in another direction than straight forwards. Usually the intention of this is to increase the effective angle of radiation of the loudspeaker: loudspeaker mechanisms are inclined in pairs in opposite directions — for example, towards both sides or upwards and downwards — and the axes of radiation are symmetrically arranged both in relation to a horizontal plane and in relation to a vertical plane at a right angle to the front of the loudspeaker. The intention can be alternatively to direct the loudspeaker means towards a certain part of the listening area. The loudspeaker mechanisms are then inclined unilaterally in one direction — i.e. some loudspeakers have a sloping front — and the axes of radiation are arranged symmetrically either in relation to a horizontal plane or in relation to a vertical plane at right angles to the front of the loudspeaker.

According to the present invention, the loudspeaker for a stereophonic or quadraphonic loudspeaker system, intended to be placed on vertical or horizontal walls, comprises a casing having a front wall and a rear wall, at least one loudspeaker mechanism or means arranged in said front wall of the casing so as to radiate the mid frequency components of the sound, and at least one loudspeaker means arranged at the side thereof so as to radiate the high frequency components of the sound. Said casing is arranged to hold said at least one loudspeaker means for the high frequency range in an inclined position in such a manner that the axis of radiation for said high frequency range points asymmetrically slantwise forwards and upwards to one side. Preferably, said casing is also arranged to hold said at least one loudspeaker means for the mid frequency range in an inclined position in such a manner that the axis of radiation for said mid frequency range points asymmetrically slantwise forwards and upwards to the same side as said axis of radiation for the high frequency range.

The stereophonic loudspeaker system according to the invention comprises two loudspeakers as described, one of which is arranged so as to direct its said asymmetrical axis or axes of radiation slantwise forwards and upwards to the left, while the other is arranged to direct its said asymmetrical axis or axes of radiation slantwise forwards and upwards to the right. Both speakers of the stereophonic loudspeaker system can thus be positioned along a vertical wall in such a manner that the axes of radiation for the frequencies referred to are directed towards a space above the preferred stereo listening positions in the listening room. The result is a considerably improved stereo reproduction. This has a liveliness and airiness to an extent which is missing with loudspeakers having their loudspeaker means facing straight forwards, and the usable listening area for geometrically good stereo reproduction is increased and becomes larger than with any other loudspeaker design known to this inventor.

With an aim to clarify, but not to limit, the invention, a number of embodiments will be described with reference to the enclosed drawings.

Figure 1:
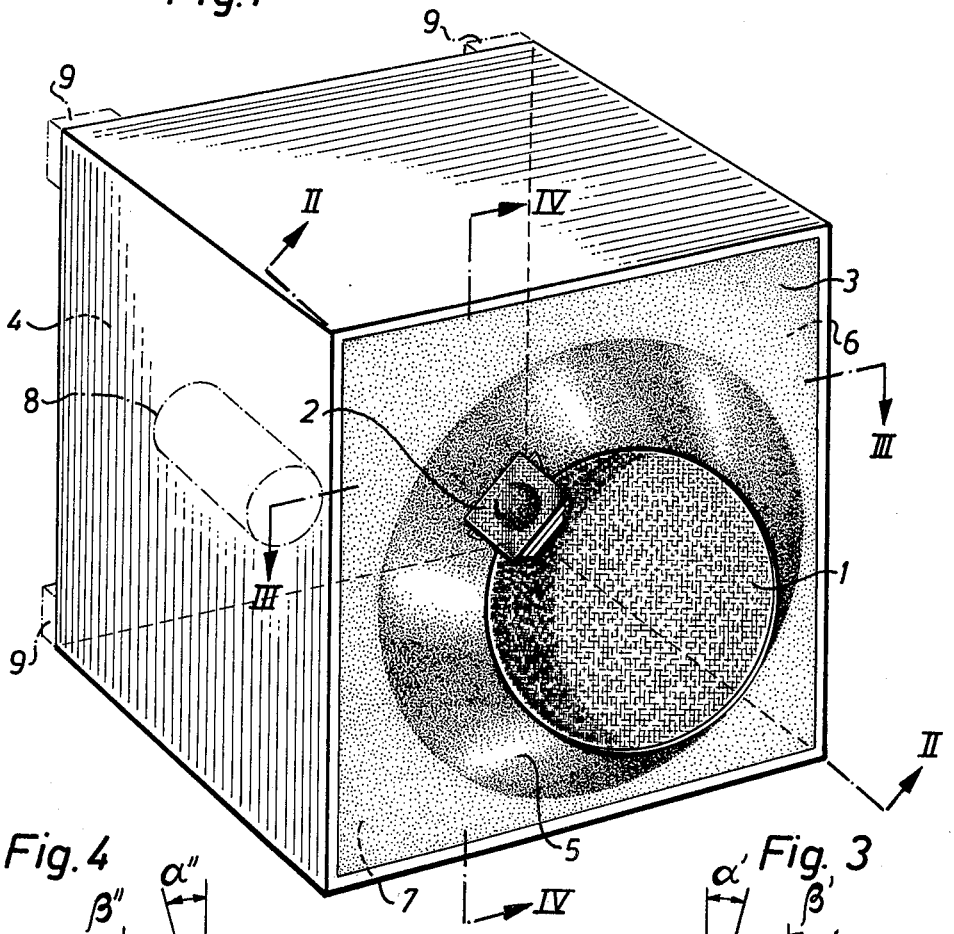
FIG. 1 is a perspective view of a loudspeaker according to the invention.

The loudspeaker shown in FIGS. 1–4 is intended for the frequency range 45–18,000 Hz. A loudspeaker mechanism 1 with an external diameter of 16.5 cm, the membrane or diaphragm of which has a diameter of 12.5 cm, is arranged to radiate the low and mid frequency ranges up to approx. 2,000 Hz, whilst a treble loudspeaker mechanism 2 with an external diameter of 5 cm, the membrane or diaphragm of which has a diameter of 3.5 cm, is arranged to radiate frequencies higher than approx. 2,000 Hz. The loudspeaker enclosure, which is cube shaped, has a front wall 3 and a rear wall 4. The front wall 3 has a concave section 5, so arranged as to hold the loudspeaker mechanisms 1 and 2 sloping in such a manner that their axes of radiation, which coincide with the symmetry axes of the loudspeaker membranes or diaphragms, are directed forwards and upwards slantwise to one side. The angle $\alpha$ between the axis of radiation of the larger loudspeaker mechanism 1 and the normal of the front wall 3 amounts to $\pi/9$ radians, whilst the angle $\beta$ between the axis of radiation of the treble loudspeaker mechanism 2 and the normal of the front wall 3 amounts to $\pi/6$ radians.

Figure 9:
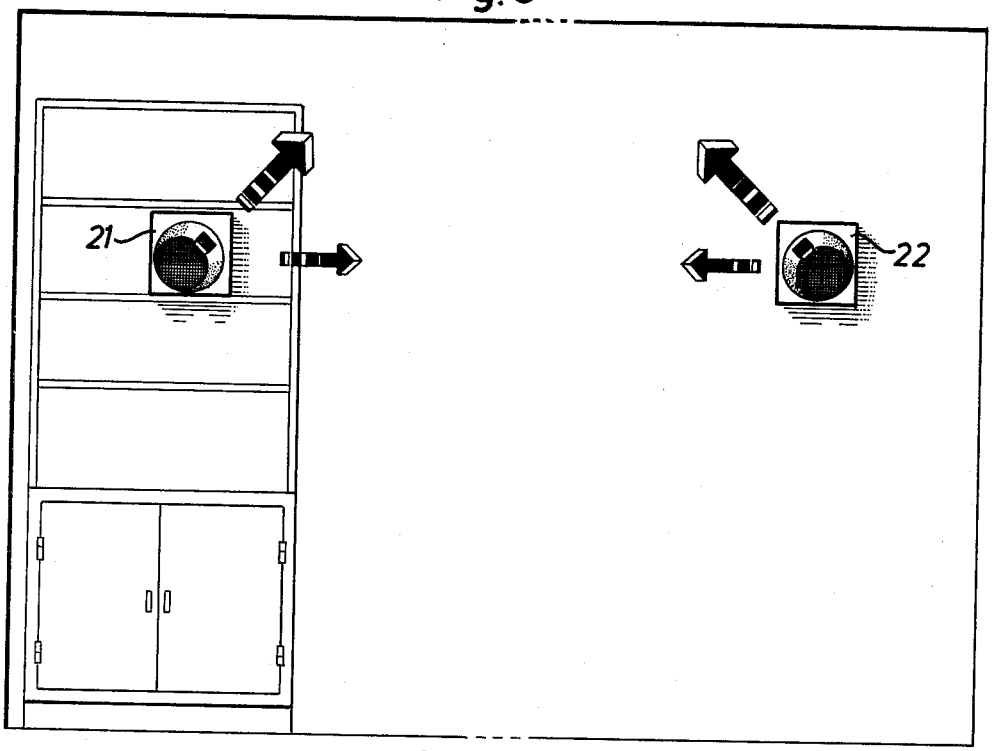
FIGS. 9 and 10 show in vertical and horizontal projection, respectively, a stereophonic loudspeaker system consisting of two loudspeakers according to FIGS. 1–4, positioned along a vertical wall in a room.
Figure 10:
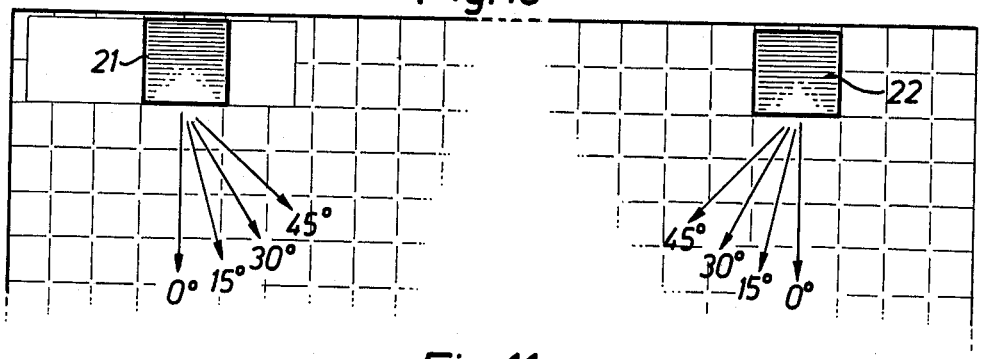

The loudspeaker is symmetrically constructed in relation to a plane at right angles to the front wall 3 through a diagonal of said front wall (line II—II in FIG. 1). Used as the left hand loudspeaker in a stereophonic loudspeaker system as shown in FIGS. 9 and 10, the loudspeaker is positioned with the wall 6 downwards, often directly on a horizontal support. Used as the right hand speaker it is positioned instead with the wall 7 downwards. The axes of radiation for the mid and high frequency ranges form in the left hand case the angles $\alpha'$ and $\beta'$, respectively, with a horizontal plane and the angles $\alpha''$ and $\beta''$, respectively, with a vertical plane at right angles to the front wall 3. In the right hand case the axes of radiation form instead the angles $\alpha''$ and $\beta''$, respectively, with a horizontal plane and the angles $\alpha'$ and $\beta'$, respectively, with a vertical plane at right angles to the front wall 3. Since the symmetry plane of the loudspeaker forms the angle $\pi/4$ radians with a vertical line and with a horizontal plane, and having $\alpha = \pi/9$ and $\beta = \pi/6$, $\alpha'$ and $\alpha''$ amount to $\pi/12.5$ radians and $\beta'$ and $\beta''$ to $\pi/8$ radians.

Having small external dimensions — a cube with 26 cm sides — this loudspeaker is easily positioned, for example on a shelf in a bookcase or suspended on a vertical wall. Both positioning methods are exemplified in the stereophonic loudspeaker system according to FIGS. 9 and 10. The rear wall of the loudspeaker is arranged for suspension on a vertical wall of the listening room.

Figure 11:
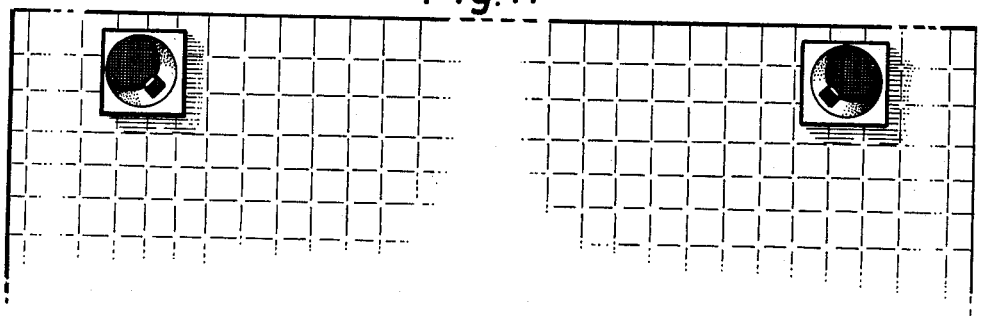
FIG. 11 shows, in horizontal projection, the stereophonic loudspeaker system according to the FIGS. 9 and 10 in an alternative position along a vertical wall in a room.

An alternative loudspeaker positioning on the floor along a vertical wall with the rear wall 4 turned towards the floor and the front wall 3 turned upwards, is shown in FIG. 11. There, the left hand loudspeaker has its wall 7 and the right hand loudspeaker its wall 6 turned towards the vertical wall. In this position the intensity of the direct sound is reduced and the intensity of the early reflected sound is increased compared with the positioning according to FIGS. 9 and 10. As long as the direct sound has sufficient intensity as compared to the reflected sound, this results in a reproduction with increased liveliness and airiness. In the matter of sufficient intensity of the direct sound in this position, the loudspeaker according to the invention is considerably superior to a loudspeaker where the angles $\alpha$ and $\beta$ are zero.

In addition to the above-mentioned improvement in stereo reproduction with a normal loudspeaker positioning according to FIGS. 9 and 10, the invention has, by making possible first class reproduction also in a position according to FIG. 11, thus resulted in a loudspeaker which offers a hitherto unknown freedom of choice as far as loudspeaker positionings for high fidelity reproduction is concerned.

In its practical embodiments the loudspeaker described has a tubular shaped opening 8 for improved reproduction of the lowest frequencies, preferably arranged in the rear wall 4 and complemented by foot-like spacing pieces 9 with the object of ensuring free passage of sound from the opening 8 between the rear wall 4 and an adjoining wall of the listening-room.

Figure 5:
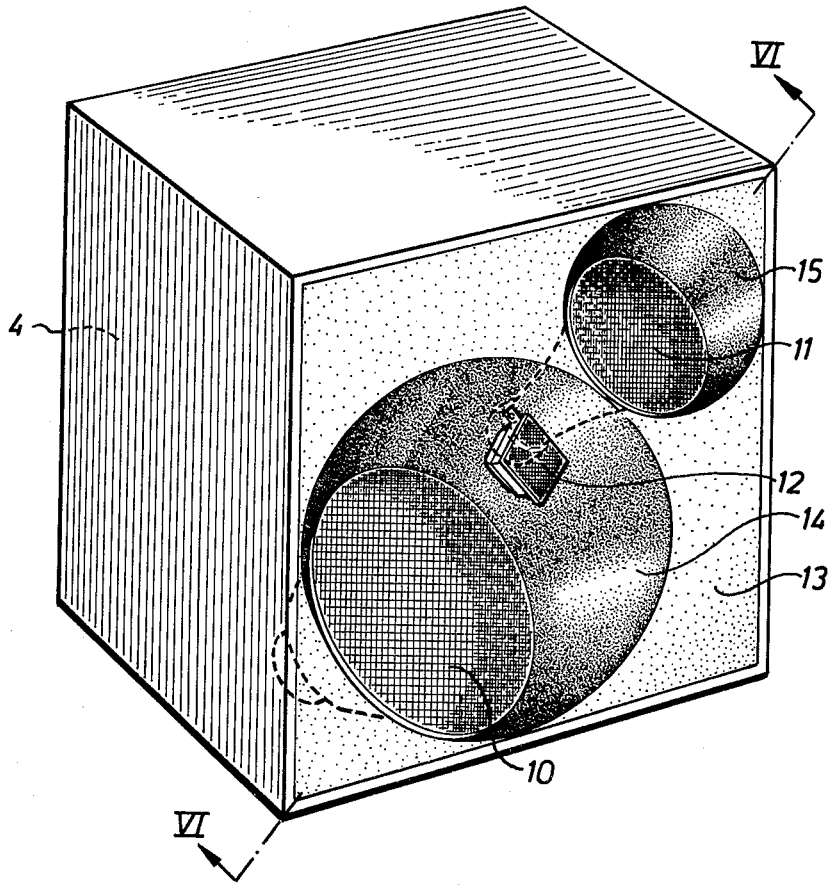
FIG. 5 is a perspective view of a modified version of the loudspeaker shown in FIGS. 1–4.
Figure 6:
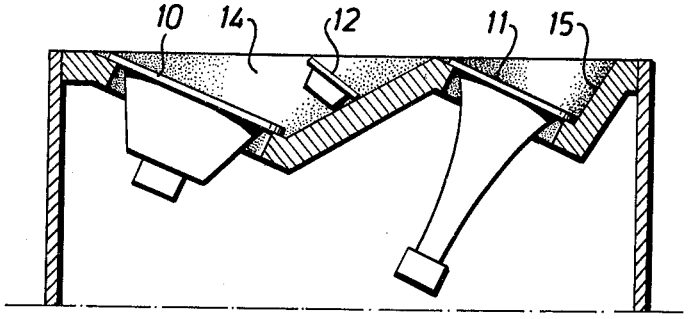
FIG. 6 is a section along the line VI—VI in FIG. 5.

A modified version of the loudspeaker described above, but intended for higher power requirements, is shown in FIGS. 5 and 6. The loudspeaker mechanism 10 with an external diameter of 23 cm, is arranged to radiate the low and mid frequency ranges, up to approx. 1.2 kHz. The loudspeaker mechanism 11, a horn speaker, is arranged to radiate part of the mid and high frequency ranges from approx. 1.2 kHz to 4 or 5 kHz. A treble loudspeaker mechanism 12 is arranged to radiate the frequency range above 4 or 5 kHz. The loudspeaker enclosure has the shape of a right-angled parallelepiped with a square front wall: external dimensions 40 × 40 × 30 cm. The front wall 13 has two concave sections 14 and 15, which are arranged to hold the loudspeaker mechanism 10 and 12 and the loudspeaker mechanism 11, respectively, in an inclined position with the axes of radiation pointing slantwise forwards and upwards to one side.

Figure 7:
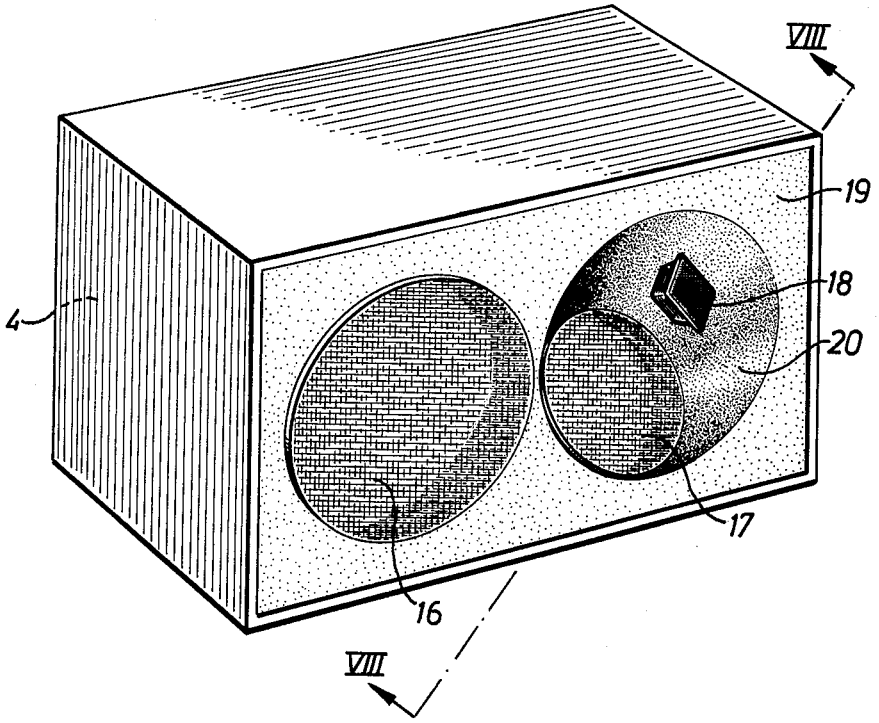
FIG. 7 is a perspective view of an alternative version of the loudspeaker according to the invention.
Figure 8:
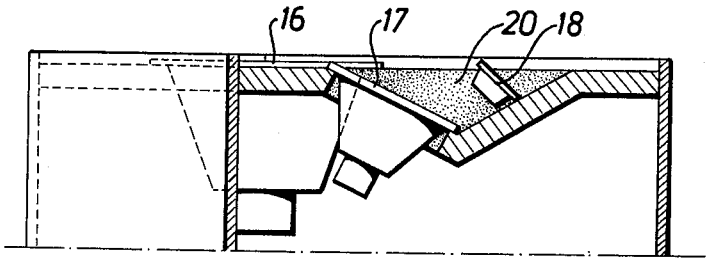
FIG. 8 is a section along the line VIII—VIII in FIG. 7.

FIGS. 7 and 8 show an embodiment of the invention the front wall of which is not square and diagonally symmetrical as in the embodiments described above. This loudspeaker is intended for high fidelity reproduction down to a lower frequency than the one first described, which requires a larger loudspeaker mechanism to be used for the low frequency range and a greater volume of air inside the loudspeaker enclosure. In order to make it suitable for positioning in a bookcase it has exterior dimensions 51 × 29 × 29 cm. The loudspeaker mechanism 16 with an external diameter of 20.5 cm is arranged to radiate the low and part of the mid frequency range up to approx. 700 Hz. The loudspeaker mechanism 17 with an external diameter of 13 cm is arranged to radiate part of the mid and high frequency ranges from approx. 700 Hz to approx. 3 kHz. The treble loudspeaker mechanism 18 is arranged to radiate the high frequency range from approx. 3 kHz to approx. 20 kHz.

The front wall 19 of the loudspeaker is arranged to hold the loudspeaker mechanism 16 so that its axis of radiation points straight forwards. Within the frequency range which this loudspeaker means is arranged to radiate, the wavelength of the sound in air is greater than three times the diameter (15 cm) of the radiating membrane. The loudspeaker mechanism 16 is then sufficiently nondirectional as to make an inclined position ineffectual.

In accordance with the invention the front wall 19 has a concave section 20 which is arranged to hold the loudspeaker mechanisms 17 and 18 in inclined positions, so that their axes of radiation point slantwise forwards and upwards to one side. The axis of radiation of the loudspeaker mechanism 17 forms the angle $\pi/6$ radians with the normal to the front wall 19, whilst the axis of radiation for the treble loudspeaker mechanism 18 forms the angle $\pi/5$ radians with the same normal.

In a modified version of the embodiment described in connection with FIGS. 7 and 8, the loudspeaker mechanism 17 with its cone shaped membrane is substituted by a loudspeaker mechanism with a dome shaped membrane having a diameter of 5 cm. As in the case of the loudspeaker mechanism 16, the front wall of the loudspeaker enclosure is arranged to hold the new loudspeaker mechanism so that its axis of radiation points straight forwards. Within the given frequency range a dome shaped membrane of this size is practically nondirectional and an inclined positioning would be without effect. In accordance with the invention, the front wall of the loudspeaker has a concave section which is arranged to hold the treble loudspeaker mechanism — the only loudspeaker mechanism in this loudspeaker which is directional within part of its frequency range — in an inclined position in the same manner as the concave section 20 of the front wall 19 of the loudspeaker according to FIGS. 7 and 8 is arranged to hold the loudspeaker mechanism 17 so that the axis of radiation of the treble loudspeaker mechanism points slantwise forwards and upwards to one side.

From the described embodiments, it appears that a large number of different embodiments of the loudspeaker according to the invention are possible.

To further a better understanding of the invention, some details of its acoustical effect will be described.

The inclined positioning, both upwards and sideways towards the listening area, of those loudspeaker means which are directional, has an effect primarily on the intensities of the direct sound and the first arriving reflected sound from the ceiling in different parts of the listening room. As the table below shows, a slantwise positioning upwards and sideways means that the direct sound will emanate from directions of the respective loudspeaker means, the angle of which with the axis of radiation will have a considerably reduced variation from one listening position to another. The direct sound to different listening positions therefore is of almost equal intensity when radiated.

At the same time the slantwise positioning results in that the directions of radiation of the sound transferred by the first ceiling reflections will have its angle with the axis of radiation of the loudspeaker means reduced. The angles of radiation of this sound will, with normal loudspeaker positioning in an ordinary living room, be of about the same size as the angles of radiation of the direct sound.

The variations in intensity of the direct sound and the sound transferred by the first ceiling reflection will be so small that the loudspeaker as far as these portions of the sound are concerned will behave approximately as a nondirectional source. The similarity to a nondirectional source is valid for the direct sound, and the early reflected sound from the ceiling and from a possible wall behind the listener. On the other hand the reflected sound from other directions — as well as the total reflected sound — will have less intensity than from a nondirectional source.

In this comparison with the nondirectional source probably lies an explanation of the increased liveliness and airiness of the reproduction of this loudspeaker. The increased intensity of the sound transferred by the first ceiling reflection is presumably sufficient, in combination with the two loudspeakers used for stereophonic reproduction, to give our hearing an impression reminiscent of a natural propagation of the sound. Regarding the frequency range where the invention is of value, it is worthwhile recalling that according to recently published investigations the frequency range around and above 8 kHz is of special importance for the listener's localisation of direction and for his acoustic experience of rooms. The outer ear is instrumental in this.

For listening positions varying between 0° and 45° lateral angle relative to the normal to the front wall of the loudspeaker (see FIG. 10) the following table presents the *angle of radiation of the direct sound,* (expressed in degrees), for some combinations of the horizontal angle of inclination ($\alpha_H$) and the vertical angle of inclination ($\alpha_V$), quoted in radians. The table is applicable to both speakers 21 and 22 individually, but does not purport to define the listening position between the speakers.

How much the angle of radiation of the direct sound varies for listening positions between 0° and 45° lateral angle for each combination of angles of inclination is given at the extreme right of the table under the heading "max-min".

The loudspeaker is assumed to be positioned in the same manner as loudspeakers 21 and 22 in the FIGS. 9 and 10, and the loudspeaker means are at ear height.

In the following table, values in brackets indicate minimum values occurring between values in columns.

| Angles of inclination | | Lateral angle of listening position | | | | | | max-min |
|---|---|---|---|---|---|---|---|---|
| $\tau_H$ | $\alpha_V$ | 0 | 15 | | 30 | | 45 | |
| 0 | 0 | 0 | 15 | | 30 | | 45 | 45 |
| $\frac{\pi}{8}$ | 0 | 22.5 | 7.5 | (0) | 7.5 | | 22.5 | 22.5 |
| $\frac{\pi}{15}$ | $\frac{\pi}{15}$ | 16.7 | (12.0) | | | | 34.9 | 22.9 |
| $\frac{\pi}{12.5}$ | $\frac{\pi}{12.5}$ | 20.0 | 14.4 | | 21.1 | | 33.5 | 19.1 |
| $\frac{\pi}{8.1}$ | $\frac{\pi}{8.1}$ | 30.0 | 23.3 | (22.2) | 23.5 | | 31.4 | 9.2 |
| $\frac{\pi}{7.68}$ | $\frac{\pi}{7.68}$ | 31.5 | 24.8 | (23.4) | 24.3 | | 31.4 | 8.1 |
| $\frac{\pi}{5.87}$ | $\frac{\pi}{5.87}$ | 40.0 | 34.1 | | 30.7 | | 33.6 | 9.3 |
| $\frac{\pi}{5.1}$ | $\frac{\pi}{5.1}$ | 45.0 | 40.0 | | 35.6 | (35.3) | 36.4 | 9.7 |

It is evident from the table that the angle of radiation of the direct sound, already when the horizontal and vertical inclinations are as small as $\pi/15$ radians, maintains its variations within 22.9° or practically the same as the mimimum of 22.5° which can be achieved by a horizontal turning only of a loudspeaker having its loudspeaker means facing straight forwards. For the listening area considered a horizontal and vertical inclination of between $\pi/8$ and $\pi/6$ radians gives an optimum with the variations in the angle of radiation of the direct sound limited to 9°.

In loudspeakers according to the invention horizontal and vertical inclinations between $\pi/8$ and $\pi/5$ radians are useful primarily for treble loudspeaker mechanisms, whilst inclinations between $\pi/15$ and $\pi/8$ radians are suitable for larger loudspeaker means, for example those intended for the reproduction of low frequencies.

The expansion of the listening area where a geometrically good stereophonic reproduction is obtained, i.e. where a recorded center source is heard midway between the two loudspeakers, occurs only when the loudspeakers are placed as in FIGS. 9 and 10 but not with a loudspeaker arrangement according to FIG. 11. It is known that such an expansion is obtained if a loudspeaker is given such a directional pattern that the intensity of sound increases with an increased lateral angle, which compensates the effect of the different times of travel of the sound from the two loudspeakers to a listener placed off-centre. Such a directional pattern is, however, not obtained solely by turning a loudspeaker means according to the inclination angles of the invention. This directional pattern is probably achieved instead as a combined effect of the inclined positioning of the loudspeaker means and the concave section of the front wall of the loudspeaker enclosure.

Figure 4:
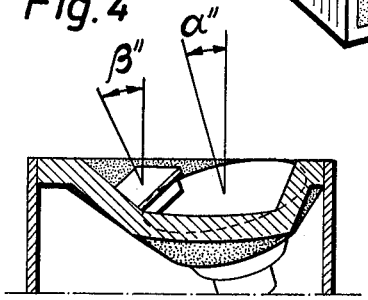
FIG. 4 is a section along the line IV—IV in FIG. 1.
Figure 3:
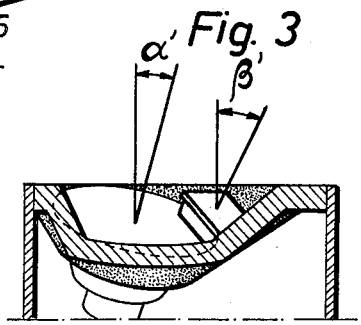
FIG. 3 is a section along the line III—III in FIG. 1.
Figure 2:
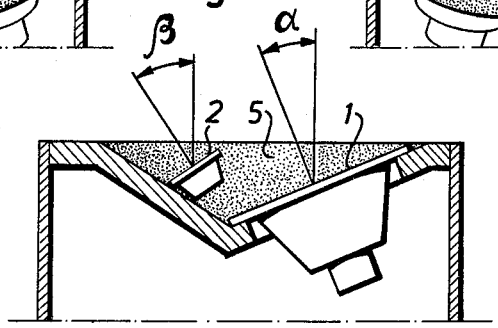
FIG. 2 is a section along the line II—II in FIG. 1.

As is apparent from FIGS. 1–8, the concave section of the front wall of the described embodiments of the invention consists of a flat, sloping section, in which a loudspeaker mechanism is arranged, and a section with a conical shape which flows smoothly into the front plane of the front wall. The conical surface is substantially concentric with said loudspeaker mechanism, and the generatrix of the cone makes approximately the angle $\pi/6$ radians with the symmetry axis of the loudspeaker mechanism. A study of the FIGS. 3 and 4 shows that the radiation in a 45° lateral angle runs practically parallel with a relatively long portion of the conical surface. The reflections in this conical surface will probably to an increasing extent add to the direct radiation when the lateral angle is increased from 0° to 45°.

With variations in the intensity of the direct sound when it leaves the loudspeaker means, limited as a result of the invention's inclination of said loudspeaker means, the increase of the direct sound which the concave section of the front wall provides with increasing lateral angle from the loudspeaker (up to in this case approx. 45°), is obviously sufficient to achieve the necessary directional pattern of the loudspeaker to compensate for the different times of travel for different listening distances from the two stereo loudspeakers.

What I claim is:

1. A loudspeaker for use in a stereophonic or quadraphonic sound reproducing system and intended to be placed on a horizontal or vertical support, said loudspeaker comprising a substantially rectangular casing having a frontal wall, a rear wall and a bottom wall which walls define a frontal direction representing a normal to a vertical room-wall in front of which said casing is positioned in close proximity, a single high frequency radiating means, said mid-frequency radiating means, the high frequency radiating means and the mid-frequency radiating means having at least one loudspeaker mechanism mounted on said front wall of the casing, and said at least one loudspeaker mechanism for the high frequency range being mounted in such a manner as to face in a forwardly and sidewardly and upwardly direction which points sidewardly at an angle of at least $\pi/15$ radians to said frontal direction and upwardly at an angle of at least $\pi/15$ radians relative to said frontal direction.

2. A loudspeaker as claimed in claim 1 in which the front wall of the casing has a concavely shaped portion to accommodate said at least one loudspeaker means for the high frequency range and to provide a sound reflecting surface for part of its sideward radiation.

3. A loudspeaker as claimed in claim 1 which has said mid range frequency radiating means inclined upwardly and sidewardly in the same general direction as said high frequency radiating means.

4. A loudspeaker as claimed in claim 3 which has said at least one loudspeaker mechanism for the high frequency range and said at least one loudspeaker mechanism for the mid-frequency range facing in directions which make vertical and horizontal angles of from $\pi/15$ to $\pi/5$ radians with said frontal direction.

5. A loudspeaker for use in a stereophonic sound reproducing system, comprising a casing having at least one wall adapted for the mounting of a loudspeaker mechanism, and further walls which constitute the position determining means of the loudspeaker, a sound radiating means for the mid-frequency range and a single high frequency sound radiating means, the high frequency sound radiating means having a loudspeaker mechanism mounted on the said at least one wall of the casing fixed directional relationship to said further walls of the casing, and the said at least one wall of the casing being arranged to hold the said loudspeaker mechanism in an inclined position, relative to the said position determining means, in such a manner that when the loudspeaker is positioned on a narrow horizontal surface which is bounded on one side by a vertical boundary surface, and the said at least one wall of the casing faces away from the vertical boundary surface, said single high frequency sound radiating means having an axis of radiation extending in an inclined direction from the loudspeaker mechanism at an angle of from $\pi/15$ to $\pi/5$ radians, with respect to a horizontal plane and at an angle of from $\pi/15$ to $\pi/5$ radians with respect to a vertical plane at right angles to the said vertical boundary surface.

6. A loudspeaker as claimed in claim 5 in which the sound radiating means for the mid range comprises a loudspeaker mechanism held in an inclined position with respect to the said position determining means, in such a manner as to face in an inclined direction, with respect to the said horizontal and vertical planes, and in the same general direction as the high frequency sound radiating means.

7. A stereo loudspeaker system, comprising two loudspeakers as claimed in claim 6, confronting a listening area in which one of said loudspeakers is positioned in front of and to the left of the listening area so as to direct the axes of radiation of its sound radiating means for the mid and high frequency ranges asymmetrically slantwise forwards and upwards to the right, whilst another of said loudspeakers is positioned in front of and to the right of the same listening area to direct the axes of radiation of its sound radiating means for the mid and high frequency ranges asymmetrically slantwise forwards and upwards to the left.

8. A loudspeaker adapted to be placed adjacent to a horizontal or vertical structural flat surface and to be used in a stereophonic reproducing system comprising a casing in the form of a right angled parallelepiped, one of the sides thereof being a front wall provided with a concavely shaped recess, a first means for radiating sounds within a frequency range located below 2,000 hz. having a first loudspeaker mechanism mounted in the recess on the front wall, and a single second means for radiating sounds within a frequency range located above 2,000 hz. having a second loudspeaker mechanism mounted in the recess on the front wall, said second loudspeaker mechanism for radiating sounds above 2,000 hz. having a diaphragm symmetrical about a central axis, the central axis being disposed in a first plane normal to one of the walls of the casing adjacent to the front wall and at an acute angle of at least $\pi/15$ radians to an axis normal to the front wall and in a second plane normal to the first plane and at an angle of at least $\pi/15$ radians to an axis normal to said front wall.

9. A stereo loudspeaker system to be placed near a vertical wall of a room defining a listening area confronting the loudspeaker system, said stereo loudspeaker system comprising a left-hand and a right-hand loudspeaker which are mirror images of one another with respect to a centered vertical plane extending transverse to said vertical wall midway between the loudspeakers and centrally of the listening area of the room; each loudspeaker comprising a casing having a frontal wall, a rear wall and a bottom wall, a single means for radiating high frequency sound having a directional axis and means for radiating mid-frequency sound, each means comprising at least one loudspeaker mechanism mounted on said frontal wall of the casing, and said directional axis extending from the casing in a forwardly and sidewardly and upwardly direction which, when said casing is positioned with its bottom wall turned downwards and its rear wall located close to said vertical wall of the room, points sidewardly at an angle of at least $\pi/15$ radians relative to the normal to said vertical wall of the room and upwardly at an angle of at least $\pi/15$ radians relative to the normal to said vertical wall of the room and slantwise towards said centered vertical plane, whereby there is an increase in the portion of the listening area in which the angle between the axis from the loudspeaker to the listening position and the directional axis of the radiation means for the high frequency sound of the left-hand loudspeaker approximates the angle between the axis from the loudspeaker to the listening position and the directional axis of the radiation means for high frequency sound of the right-hand loudspeaker.

10. A stereo loudspeaker system as claimed in claim 9 in which the means for radiating mid-frequency sound is a single source and has a second directional axis inclined upwardly and sidewardly in the same general direction as said first directional axis.

11. A stereo loudspeaker system as claimed in claim 9 in which the vertical and horizontal inclinations of said high frequency radiating means are no greater than $\pi/5$ radians when said left-hand and right-hand loudspeakers are positioned in normal relation to said vertical wall of the room.

12. A stereo loudspeaker system as claimed in claim 9 wherein the means for radiating high frequency sounds radiates sounds within a frequency range above 2,000 hz.

13. A stereo loudspeaker system as claimed in claim 9 in which said frontal wall of the casing has a concavely shaped portion to accommodate said at least one loudspeaker means for the high frequency range and to provide a sound reflecting surface for part of its sideward radiation.

* * * * *